United States Patent [19]

Giordano

[11] 3,949,930

[45] Apr. 13, 1976

[54] ARTICLE CARRIER

[75] Inventor: David J. Giordano, Colonia, N.J.

[73] Assignee: Slater Paper Box, Inc., Fall River, Mass.

[22] Filed: Mar. 24, 1975

[21] Appl. No.: 561,499

[52] U.S. Cl. ..... 229/28 R; 206/139; 206/427; 229/29 B; 229/29 F

[51] Int. Cl.[2] ..... B65D 5/48

[58] Field of Search .... 229/28 R, 29 R, 29 B, 29 D, 229/29 F; 206/45.14, 139, 196, 427

[56] References Cited

UNITED STATES PATENTS

| | | | |
|---|---|---|---|
| 2,761,785 | 9/1956 | Steger | 229/38 R X |
| 2,919,844 | 1/1960 | Anderson, Jr. | 229/28 R |
| 3,596,758 | 8/1971 | Phillips, Jr. et al. | 229/28 R X |
| 3,840,171 | 10/1974 | Waters | 229/28 R |

*Primary Examiner*—William Price
*Assistant Examiner*—Stephen P. Garbe
*Attorney, Agent, or Firm*—Barlow & Barlow

[57] ABSTRACT

An article carrier container is formed from an elongated blank including top deck sections with apertures or holes therein, side walls and a lower deck together with an extension flap extending from one row of holes of the top deck, the extension flap having a tongue cut from a central portion thereof adjacent the row of holes and a further portion which is adapted to be folded back under at least one row of holes and thence downward to be secured to the lower deck, the cutout tongue also being adapted to be secured to the lower deck so as to form a plurality of tubular compartments of the extension portion and flap forming the device.

4 Claims, 3 Drawing Figures

ARTICLE CARRIER

BACKGROUND OF THE INVENTION

An article carrier of this general type herein disclosed has previously been suggested in the Waters U.S. Pat. No. 3,840,171. While this previous construction has proved to be satisfactory, it has been found that it utilizes a larger blank of cardboard material than is necessary to provide the necessary strength and structure. With material costs soaring, it is desirous to maintain the article carrier in as competitive a position as is possible and make it as economically as possible and therefore the solution appears to be in the matter of saving of material and weight.

SUMMARY OF THE INVENTION

An article carrier is formed of the necessary tubular construction having a top deck with holes therein and a bottom deck and the division walls are provided with extending the blank in one direction, cutting a tongue therefrom and folding back the extended portion of this flap underneath at least one row of holes and thence downwardly to the bottom wall to secure the flap thereto and also fold the tongue, which was cut from the extension, down to the bottom wall and secure it at a location spaced from the extended portion so as to form a plural compartmentation type of tubular construction for an article carrier. In this particular manner of striking the carrier from a single blank of material, considerable saving is had over that previously proposed since at least one division wall is eliminated in length of the blank, the same now being formed by a cutout tongue in the double back portion as disclosed in the aforementioned Waters patent. It will be obvious that if the compartmentation is to be extended beyond the three compartments illustrated, this may be done by following the teachings of the Waters patent in the second embodiment thereof.

DESCRIPTION OF THE PREFERRED EMBODIMENT

Figure 1:
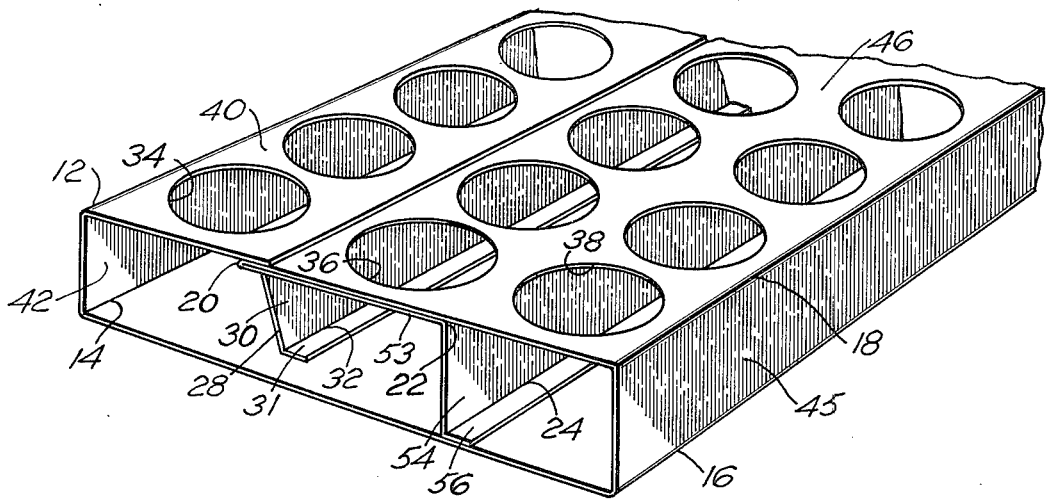
FIG. 1 is a perspective view of a fragmental portion of an article carrier folded into tube form in accordance with the invention.

With reference to the drawing a single sheet of cardboard stock material 10, (FIG. 2), which forms a blank, is adapted to be folded and secured to the position as shown in FIG. 1 so as to hold a plurality of articles. The blank 10 may be made from any suitable material, such as paper board or the like, and in order to prepare the blank 10 for assembly, the blank is scored by a plurality of score lines transverse to its longitudinal dimension by score lines 12, 14, 16, 18, 20, 22 and 24. The blank 10 is cut along a line 26 and 27, 28, together with 27′, 28′ to form a tongue 30 which is itself scored as at 32. Rows of holes 34, 36, 38 are cut into the blank and in this formation the blank is ready to be folded and assembled into the tubular article carrier shown in FIG. 1.

In order to accomplish this assembly, the blank is folded about the fold lines 12 and 14 and in this manner the top wall portion 40 is joined by the side wall portion 42 and lies over a section of the bottom wall 44. Thence the blank may be folded about the score lines 24, 22, 20. The tongue 30 may be folded about its score line 32 and thence the assembly can be folded about the score lines 18 and 16 and in this fashion the top wall portion 46 is brought over the bottom or lower deck 44 spaced by the wall 45. The flap 30 is then extended downwardly towards the lower deck 44 with the flange 31 folded at right angles which flange 31 is secured to the lower deck 44. The extension flap portion which has been generally indicated 50 is folded along score line 20 back underneath the top deck 46 with the sections 52, 53 secured underneath the top deck 46, and then the final division wall 54 is folded down toward the lower deck about the score line 22 and the flap 56 is folded outwardly about its score line 24 and the flap 56 is secured to the lower deck. The top wall portion 40 is secured to the top wall portion 46. In this fashion three rows of holes are adequately supported above the lower deck, and the tubular form of article carrier may be readily collapsed and shipped in flat form by moving the top wall portions 40 and 46 to the left as viewed in FIG. 1.

Figure 2:
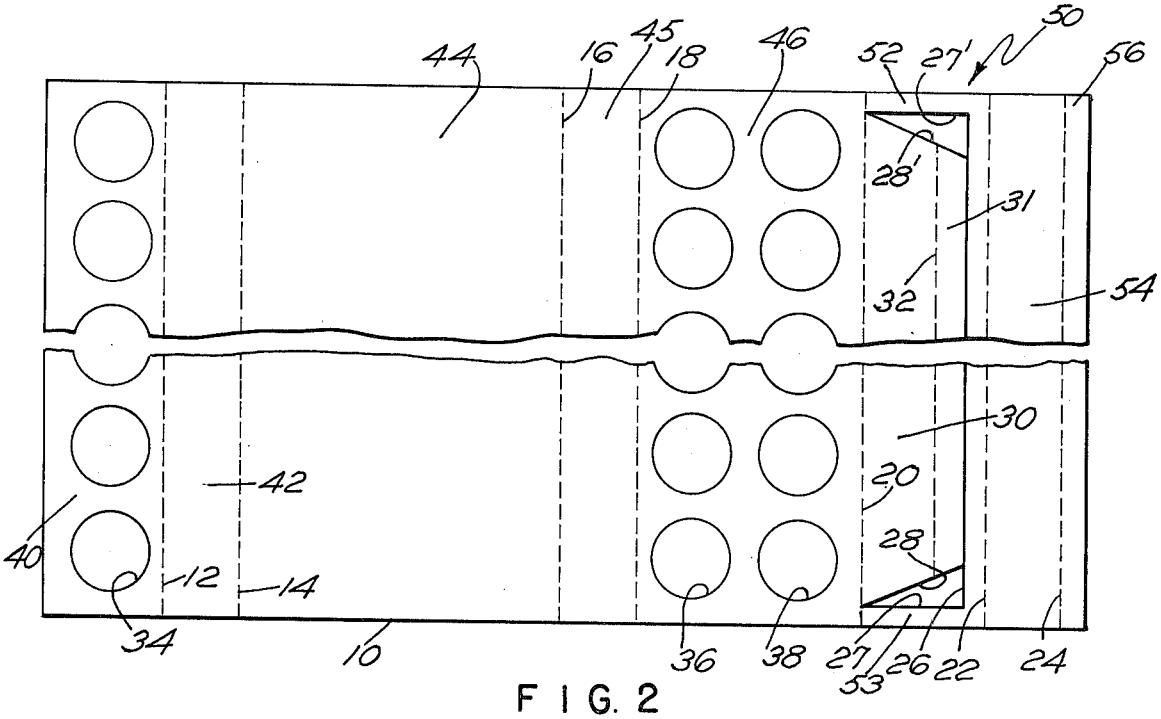
FIG. 2 is a plan view of the blank from which the article carrier is folded showing in dotted lines the score lines.
Figure 3:
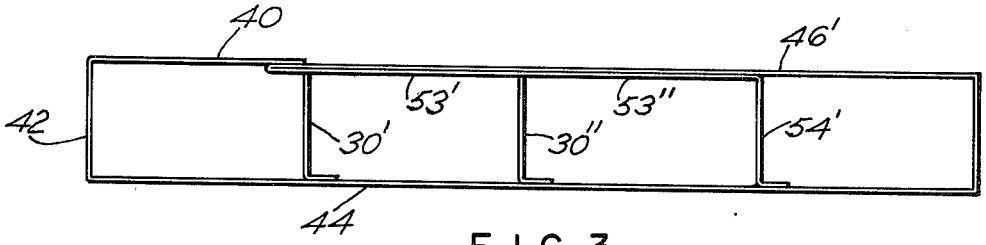
FIG. 3 is a sectional view of an alternative embodiment of the article carrier.

An alternate embodiment of the article carrier utilizing the teachings of the instant invention is shown in FIG. 3. In this version, in effect, the top wall portion 46′ is formed with three rows of holes rather than the two as shown in the blank of FIG. 2 and the extension of the blank to the right of the drawing as seen in FIG. 2 is changed somewhat by adding another section 53″ with a tongue 30″ between the sections 53′ and 54′. In all other respects the carrier is similar to that previously described but now provides for four rows of holes rather than the three rows of holes as shown in FIG. 1.

I claim:

1. In a carrier for a plurality of articles comprising a single sheet of cardboard material scored and folded into tubular form and having spaced upper and lower decks with longitudinal side walls extending between said decks, said upper deck having spaced rows of article receiving holes, a plurality of longitudinally extending supporting walls between the upper and lower decks providing a plurality of compartments, said upper deck including a flap portion folded back underneath a row of holes and then downwardly into contact with the lower deck, said flap portion having a tongue cut from the central portion thereof beneath said row of holes and folded downwardly from said flap portion into contact with the lower deck.

2. In a carrier as in claim 1 wherein the supporting walls have flanges at their ends extending along one of said decks and secured thereto.

3. In a carrier as in claim 1 wherein the tongue cut from the extending flap is of a size to provide an opening registering with the article receiving holes.

4. In a carrier for a plurality of articles as in claim 1 wherein said supporting walls are on opposite sides of said row of holes in the upper deck and form one of said compartments.

* * * * *